US005772767A

United States Patent [19]

Chambers et al.

[11] Patent Number: 5,772,767

[45] Date of Patent: Jun. 30, 1998

[54] SPRING AND SHAFT ASSEMBLY FOR HANDLING AND DIPPING FLEXIBLE BELTS

[75] Inventors: John S. Chambers, Rochester; Ronald E. Godlove, Bergen; Huoy-Jen Yuh, Pittsford; Timothy J. Leenhouts, Fairport; Rachael A. Forgit; Robert T. Cosgrove, both of Rochester, all of N.Y.

[73] Assignee: Xerox Corporation, Stamford, Conn.

[21] Appl. No.: 767,896

[22] Filed: Dec. 17, 1996

Related U.S. Application Data

[62] Division of Ser. No. 556,246, Nov. 9, 1995, Pat. No. 5,626,918.

[51] Int. Cl.[6] ..... B05C 3/00; B05C 13/00

[52] U.S. Cl. ..... 118/428; 118/500; 118/504; 279/102

[58] Field of Search ..... 118/428, 500, 118/504; 279/96, 102, 103

[56] References Cited

U.S. PATENT DOCUMENTS

| | | | |
|---|---|---|---|
| 4,680,246 | 7/1987 | Aoki et al. | 118/500 |
| 5,186,477 | 2/1993 | Nakazawa et al. | 118/500 |
| 5,282,888 | 2/1994 | Fukawa et al. | 118/428 |

*Primary Examiner*—Donald E. Czaja
*Assistant Examiner*—Michael P. Colaianni

[57] ABSTRACT

This invention discloses an apparatus for holding and transporting a hollow flexible belt throughout a coating process. The apparatus includes a spring and shaft assembly which is placed into the hollow portion of a seamless flexible belt. The spring portion of the assembly until it is transformed into a belt carrying chucking device. The chucking device is then attached to a mechanical handling device, and the the belt is transported through the dipping and coating process. This allows the belt to be transformed into an organic photoreceptor. The chucking device and flexible belt are then removed from the mechanical handling device, and the chuck is removed from the inside of the photoreceptor.

9 Claims, 16 Drawing Sheets

SPRING AND SHAFT ASSEMBLY FOR HANDLING AND DIPPING FLEXIBLE BELTS

This application is a division of application Ser. No. 08/556,246, filed Nov. 9, 1995 now U.S. Pat. No. 5,626,918.

This invention relates generally to a method and apparatus for internally holding a flexible belt for processing. More specifically, the invention relates to a spring and shaft assembly which is used to handle and transport a flexible belt so a photosensitive layer may be deposited onto its surface.

BACKGROUND OF THE INVENTION

Imaging members for printers and the like are typically coated by immersing a hollow cylinder into a stainless steel dip tank that contains a liquid coating solution. The cylinder is slowly withdrawn from the dip tank, to allow the appropriate amount of solution to remain on the surface of the cylinder. This will cause the desired coating thickness to be retained after drying. Present dipping and coating methods involve gripping the cylinder at one end by a mechanical handling device.

Substrates for these imaging members are coated with at least one active electrophotographic layer, and can be made from rigid cylindrical drums as indicated above, or from flexible belts for which the present invention will be used. By manufacturing the substrate from a flexible belt rather than from a drum, the speed at which the electrostatic image is reproduced is dramatically increased. In addition, using a seamless flexible belt will eliminate problems such as seam breakage and contamination. But problems arise when attempts are made to coat flexible belts, rather than rigid cylindrical drums using known dipping and handling processes. The flexible belts from which electrophotographic imaging members are made can easily be damaged as they are handled during photoreceptor fabrication. Typical photoreceptor substrates are made from materials that include, but that are not limited to, nickel, stainless steel, aluminum, brass, polymerics, and paper. In order to prevent the belt from becoming damaged, it is best to support it along the width of its inside surface during the coating and drying process until the finished photoreceptor is cut to its final width and packaged.

In order to conserve coating material, and to provide an internal contact surface for electrical grounding or biasing it is desirable to confine the coating to the exterior surface of the belt. This is presently achieved by dipping the belt such that the axis is maintained in a vertical position. The ends of the belt must also be sealed such that air is trapped within the lower potion of the belt. This prohibits the fluid from migrating or coating the inside of the belt.

The following disclosures may be relevant to various aspects of the present invention:

U.S. Pat. No. 5,334,246 discloses a dip coat process material handling system and method for coating multiple layers of material on a hollow cylindrical member. This system is used to produce a multi-layer optical photoconductive drum, and is an example of the type of system in which the present invention may be used.

U.S. Pat. No. 5,626,918 handling and dipping seamless flexible belts using a blow molded chucking device. A polymer insert is placed inside the circumference of a flexible belt, and blow molded to form a belt-carrying chucking device. The chucking device is then used to transport the belt during a dipping and coating process.

Techniques for handling and dipping these substrates as they proceed through the manufacturing process are well known. For example, U.S. Pat. No. 5,358,296 discloses an apparatus and method for holding a rigid hollow cylindrical substrate along its inside surface. The device consists of a porous substance mounted upon a fluid passageway. The porous substance is inflated until it engages the inner surface of the substrate in the radial direction. The device continues to engage the inner surface of the substrate until a suction force is applied.

U.S. Pat. No. 5,328,181 discloses an apparatus and method for transporting and coating rigid hollow cylinders. The invention consists of a mandrel which has an expandable disk at one end and a means for expanding the expandable disk at the other. The disk is expanded in a radial direction from the mandrel such that it comes into contact with the inner surface of the hollow cylindrical substrate. This results in the formation of an air tight seal between the disk and the substrate, and prevents the coating fluid from coming in contact with the inner surface of the substrate during dipping.

U.S. Pat. No. 5,328,180 discloses a rigid clamp used to grip and support tubular objects. A linkage is attached to clamping shoes which are then expanded outward in the radial direction. The clamping shoes are brought in contact with the inside surface of the tubular object.

U.S. Pat. No. 5,318,236 discloses a device which is inserted into a roll of coiled sheet material to provide support for the sheet as it is unrolled. The device consists of a hub assembly with an axle and two rotatable hub centers that are connected to support members. The support members move in the radial direction, and engage the interior surface of the hollow roll.

U.S. Pat. No. 5,314,135 discloses an expandable mandrel used to mount a core for winding a web of sheet material. The mandrel acts as a cam which slides in an outward radial direction and comes in contact with the inside surface of the hollow core.

U.S. Pat. No. 4,680,246, discloses a method for forming a photosensitive layer on the surface of a cylindrical drum by immersing the drum into a solution of photosensitive material. A fluid tight inflatable member is used to hold the drum while it is submerged in the solution This inflatable member is tightly pressed onto the inside wall of the drum, and prevents the photosensitive solution from contacting its inside surface.

All of the references cited herein are incorporated by reference for their teachings.

SUMMARY OF THE INVENTION

In accordance with the invention, there is provided a method and apparatus for transporting a flexible belt as it progresses through a dipping and coating process. Dipping and coating the flexible belt in the manner herein described will transform the flexible belt into an organic photoreceptor.

In accordance with one aspect, there is provided a method of handling and dipping a flexible belt defining a closed loop comprising: providing a mechanical handling device at an end of a spring and shaft assembly, wherein the spring and shaft assembly includes a spring mounted to a shaft such that the inside surface of the spring is attached to the outer surface of the shaft; placing the spring portion of the spring and shaft assembly inside a circumference defined by the flexible belt; expanding the spring in a radial direction from the shaft to engage the interior portion of the flexible belt in sealing and carrying relationship therewith; transporting the spring and shaft assembly and the flexible belt along a path to a fluid reservoir; dipping the flexible belt in a fluid contained in the fluid reservoir; transporting the spring and shaft assembly and the flexible belt out of and away from the fluid reservoir; and removing the spring and shaft assembly from the interior of the flexible belt.

In accordance with another aspect of this invention, there is provided a spring and shaft assembly for transporting and handling a flexible belt comprising: a shaft; a spring assembly mounted to an end of the shaft such that an inside surface of the spring assembly is attached to an outer surface of the shaft; an activator for adjusting a diameter of the spring assembly to engage and disengage an inside surface of the flexible belt; a sealing arrangement for preventing an inside surface of the flexible belt from being coated by a surrounding fluid; and a protrusion for attaching an end of the shaft to a mechanical handling device.

Use of this invention can eliminate a substantial amount of the damage that presently occurs to an organic photoreceptor during fabrication. The invention provides an arrangement for supporting the flexible belt along its inside surface during dipping and coating. It will also allow the inside of the belt to be sealed, thereby trapping air within its lower portion and prohibiting the surrounding solution from migrating or coating the inside of the belt.

BRIEF DESCRIPTION OF THE DRAWINGS

These and other aspects of the present invention will become apparent as the following description proceeds and upon reference to the Figures which represent preferred embodiments.

DETAILED DESCRIPTION OF THE PREFERRED EMBODIMENT

Figure 6A:
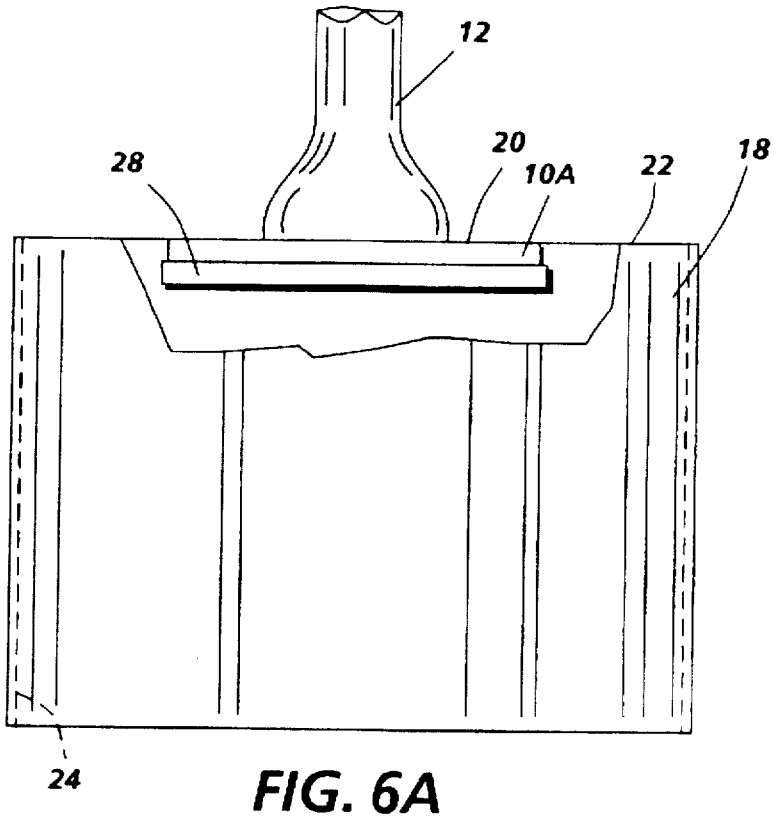
FIG. 6A depicts a cut away view of a clock spring and shaft assembly after it has been placed inside the circumference of a flexible belt prior to expansion.
Figure 6B:
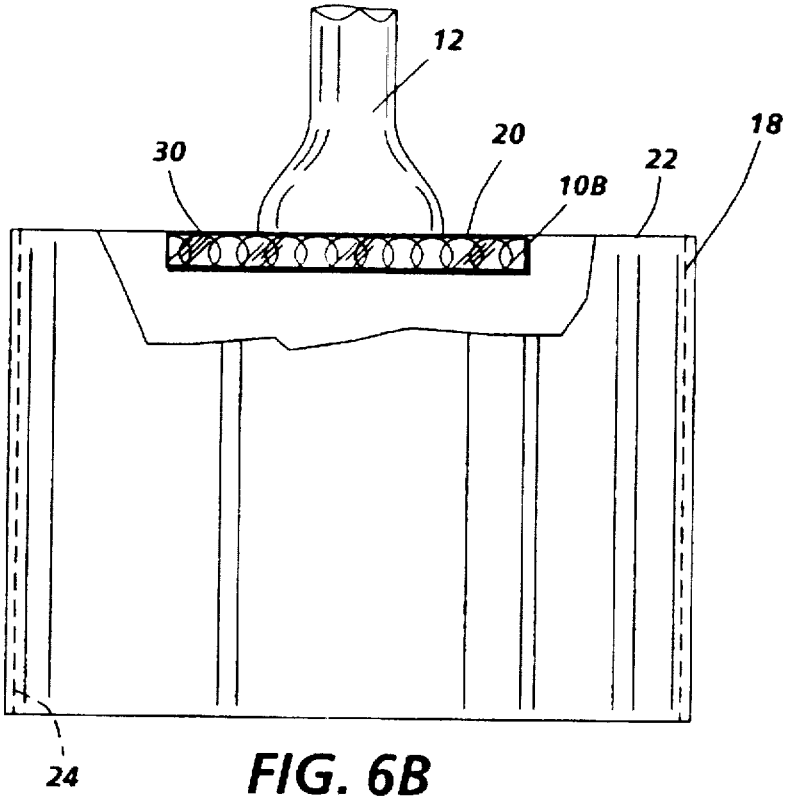
FIG. 6B depicts a cut away view of a coiled spring and shaft assembly after it has been placed inside the circumference of a flexible belt prior to expansion.

Referring now to the drawings where the showings are for the purpose of describing an embodiment of the invention and not for limiting same, FIGS. 6A, and 6B depict a device used to transport a flexible belt 18 through a manufacturing process. The device includes a shaft 12, a detail of which is provided in FIG. 1, with a spring mounted at one end.

Figure 1:
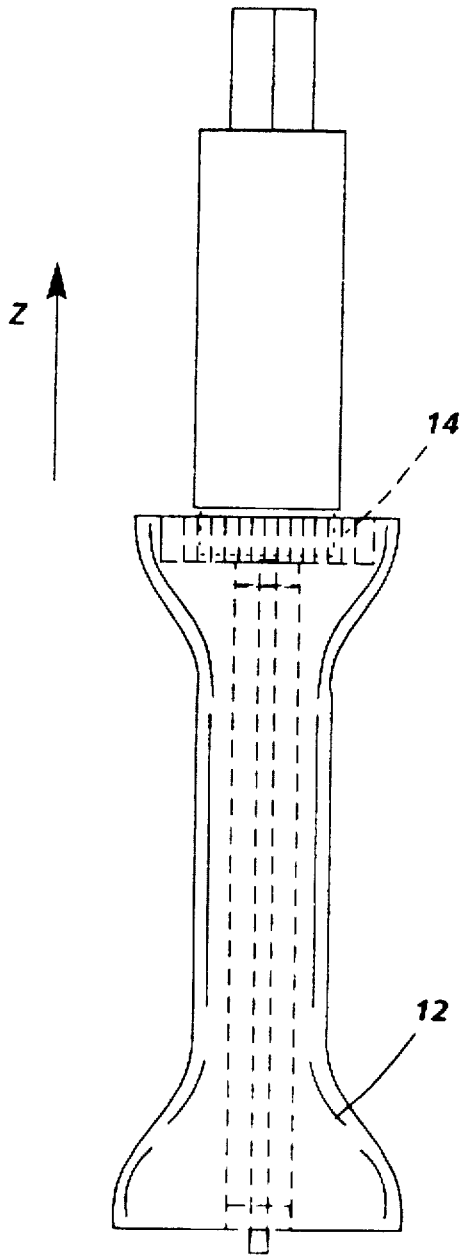
FIG. 1 depicts an elevation view of a typical shaft used in this invention.
Figure 2A:
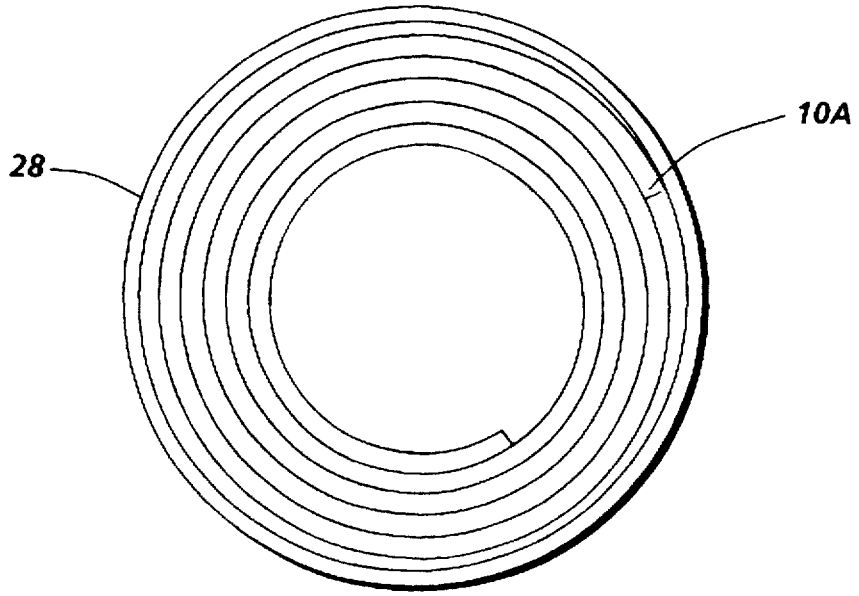
FIG. 2A depicts a plan view of a clock spring that may be used in this invention.
Figure 2B:
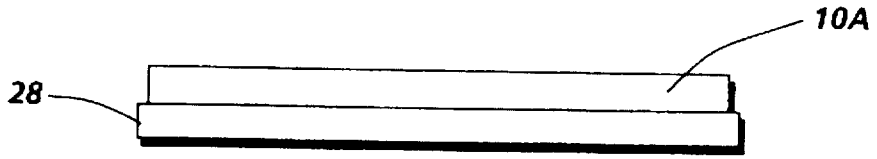
FIG. 2B depicts an elevation view of a clock spring that may be used in this invention.

Spring 10A, illustrated in FIGS. 2A and 2B, is one type of spring that may be used with this invention. As shown, spring 10A is a clock spring with an elastomeric gasket 28 attached to it on one side. Gasket 28 lies in a plane normal to the "z" axis of shaft 12 depicted in FIG. 1.

Gasket 28 should be made from a material that can be subjected to repeated expansion and contraction without loosing its dimensional stability. The material should also be chemically inert so that it can withstand the vapors that are present in the organic solvents used during the coating process, and heat resistant so that it will not break down as the belt is dried. Examples of acceptable materials are filled vinylidene fluoride hexafluoropropylene tetrafluoroethylene copolymer (hereinafter VITON) which is manufactured by Du Pont, EPDM—a terpolymer elastomer made from ethylene-propylene diene monomer also known as EPT ethylene-propylene terpolymer also manufactured by DuPont, and sold under the trade name "Nordel," "Oxytuf, " manufactured to Oxidental Chemical Company, and polydimethylsiloxane (hereinafter PDMS) which is commonly known in the industry. The invention is not limited to these materials, and other chemically stable heat resistant materials which meet these requirements may be used as well.

Figure 3A:
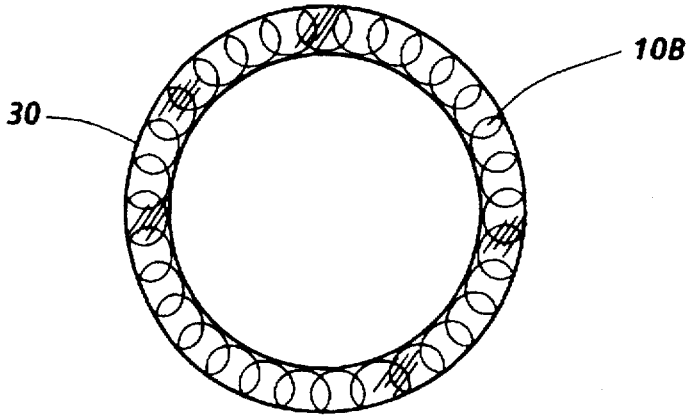
FIG. 3A depicts a plan view of a retractable coiled spring that may be used in this invention.
Figure 3B:
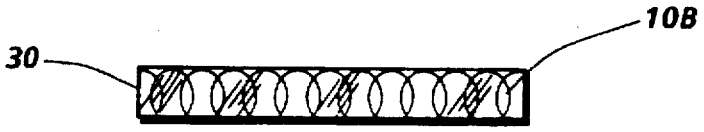
FIG. 3B depicts an elevation view of a retractable coiled spring that may be used in this invention.

Spring 10B, illustrated in FIGS. 3A and 3B, is another type of spring that may be used in this invention. As the figures show, coiled spring 10B is encased in a thin elastomeric coating 30 before it is attached to shaft 12. As depicted in FIGS. 1, 3B, and 4B coiled spring 10B is mounted in a plane normal to the z axis of shaft 12. Like gasket 28, elastomeric coating 30 should be made from a chemically inert, heat resistant material that can be subjected to repeated expansion and contraction without loosing its dimensional stability. Again, filled VITON, EPDM and PDMS may be successfully used with this invention, but these materials do not represent the sole embodiments.

The diameters of both springs 10A and 10B are adjustable, to allow for their insertion into and removal from the interior of the flexible belt 18. Each can be expanded to support the flexible belt 18 as it progresses through a dipping and coating process. As shown in FIG. 1, gear 14 is present at one end of shaft 12. Gear 14 will be used to adjust the diameter of spring 10A or 10B.

While only two types of springs have been described, springs with many different configurations may be used with this invention, and the invention is therefore, not limited to the disclosed embodiments. For convenience purposes, the invention will hereinafter be described with reference to clock spring 10A. Coiled spring 10B, and numerous other springs may used instead of clock spring 10A. Distinctions between the operation of clock spring 10A and coiled spring 10B will be drawn when necessary to accurately describe the relevant aspects of the invention. Illustrations which depict both embodiments are included in the enclosed figures.

Figure 4A:
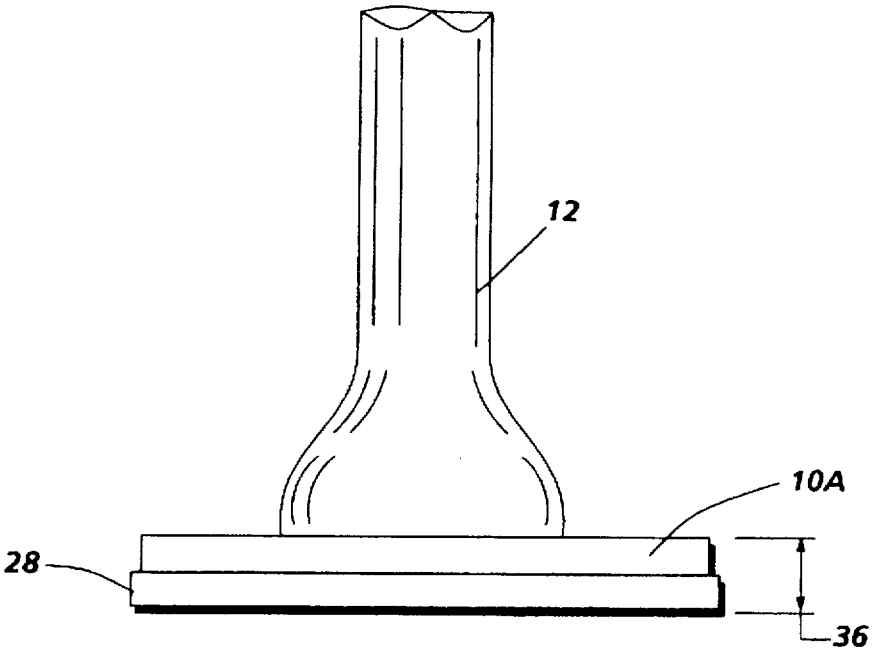
FIG. 4A depicts an elevation view of a clock spring and shaft assembly prior to insertion into the flexible belt.
Figure 4B:
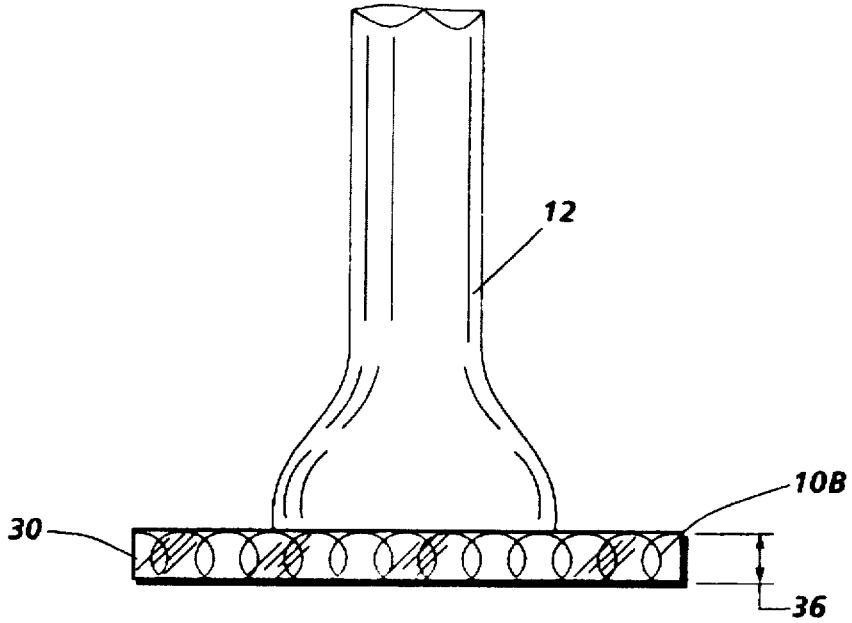
FIG. 4B depicts an elevation view of a retractable coiled spring and shaft assembly prior to insertion into the flexible belt.

Spring 10A is attached to an end of shaft 12 as depicted in FIG. 4A. As shown, spring 10A has a cylindrical shape, and its inner circumference is mounted along the outer circumference of shaft 12, normal to its z axis, at the end opposite gear 14. The diameter of spring 10A may be varied throughout the use of the invention as it is necessary to support flexible belts 18 with different diameters. While the height 36 of any single spring 10A is fixed, springs 10A with different heights 36 can easily be manufactured to provide additional support along the width of flexible belt 18 when necessary.

Figure 5A:
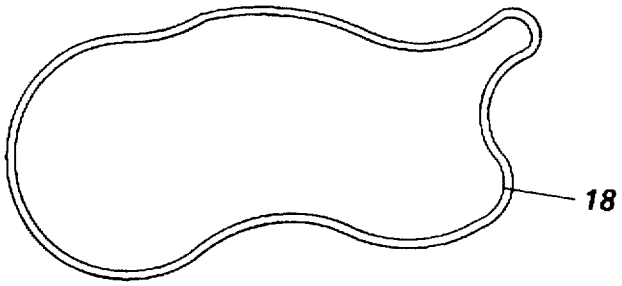
FIG. 5A depicts a plan view of a typical flexible belt that may be used in this invention.
Figure 5B:
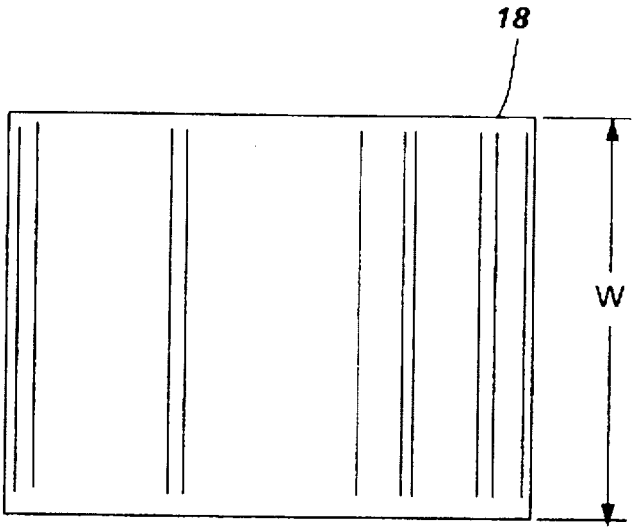
FIG. 5B depicts an elevation view of a typical flexible belt that may be used in this invention.

A flexible belt 18 for which this invention will be used is shown in FIGS. 5A and 5B. Flexible belt 18 is the type typically used to manufacture organic photoreceptors that are used in electrophotographic copying machines.

Figure 7A:
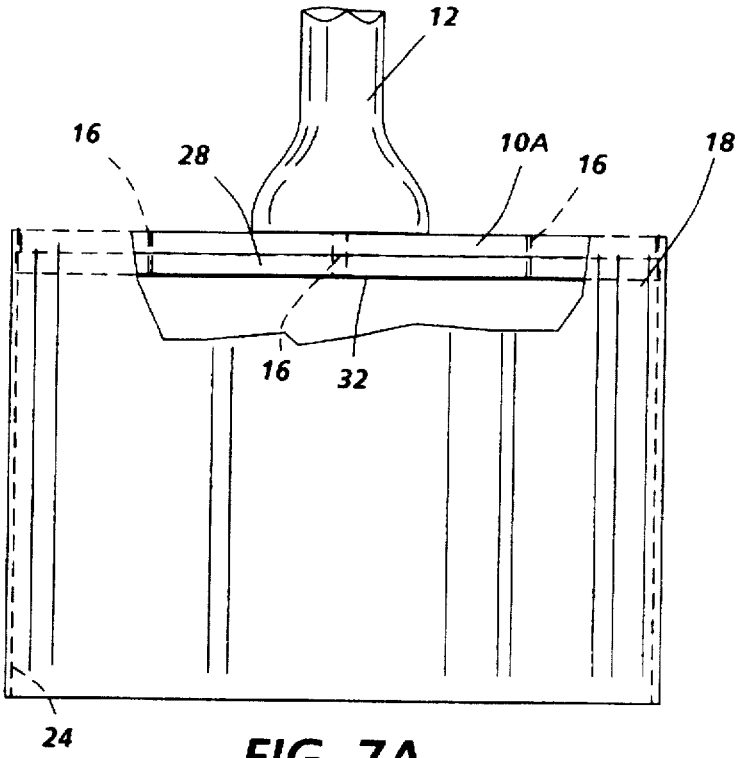
FIG. 7A depicts a cut away view of a clock spring and shaft assembly after it has been placed inside the circumference of a flexible belt and expanded.

Once spring 10A has been mounted to the end of shaft 12, the assembly is placed inside the top of the circumference of flexible belt 18 as depicted in FIG. 6A. As shown in the illustration, shaft 12 is inserted just far enough into the top of flexible belt 18 to allow the top side 20 of spring 10A to lie in the same plane as the top edge 22 of flexible belt 18. Gasket 28 will be located inside the top edge 22 of flexible belt 18. After spring 10A has been properly placed in this position, it will be expanded in the outward radial direction toward the inner circumference 24 of flexible belt 18, as depicted in FIG. 7A. As spring 10A moves outward toward flexible belt 18, the sides of gasket 28 will become trapped between the inner circumference 24 of flexible belt 18, and the outer circumference of clock spring 10A. The remainder of gasket 18 will lie on the under side 32 of spring 10A at the top of flexible belt 18, forming a tight seal. When coiled spring 10B is used, it will be located at the top end of the flexible belt 18 as depicted in FIG. 6B once shaft 12 has been inserted into the top of flexible belt 18. The coated spring 10B will be expanded until its outer diameter comes in contact with the interior of flexible belt 18.

Spring 10A and shaft 12 will be used to dip flexible belt 18 into fluid 38. During dipping, the axis of flexible belt 18 must be maintained in a vertical position. Immersing flexible belt 18 in fluid 38 in this manner will cause the presence of gasket 28 to build up an air pressure column inside flexible belt 18.

Figure 7B:
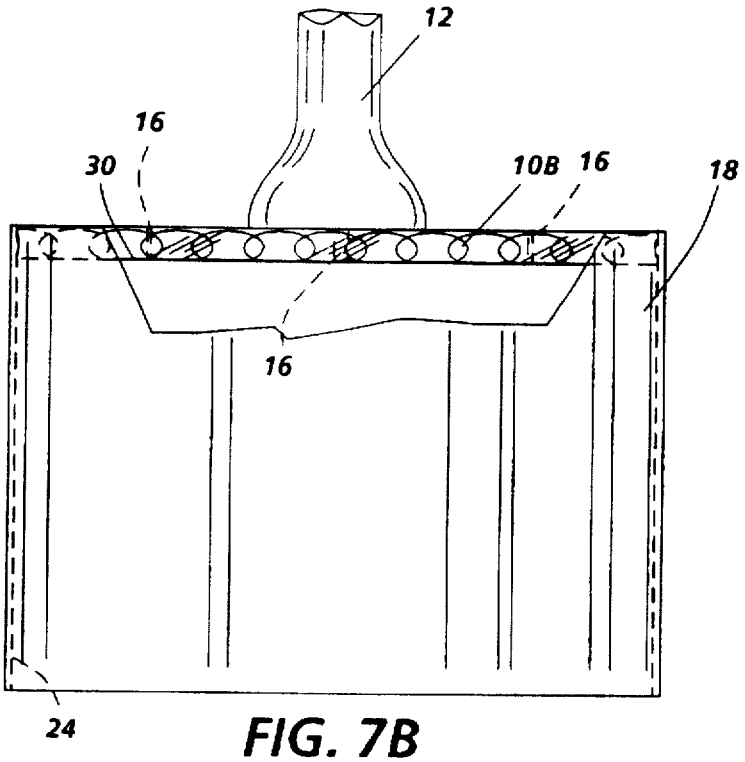
FIG. 7B depicts a cut away view of a retractable coiled spring and shaft assembly after it has been placed inside the circumference of a flexible belt and expanded.

When coiled spring 10B is used, elastomeric coating 30 will be used to seal the inside of flexible belt 18 from the surrounding fluid. Once it has been expanded to contact the inside edge of flexible belt 18, elastomeric coating 30 will form a tight seal with the top edge of flexible belt 18 as shown in FIG. 7B. This will cause the air pressure column to build-up inside of flexible belt 18 during dipping. This column of air will prevent the migration of fluid into the interior of belt 18, thereby allowing its inside surface to remain virtually free from fluid 38.

Figure 8A:
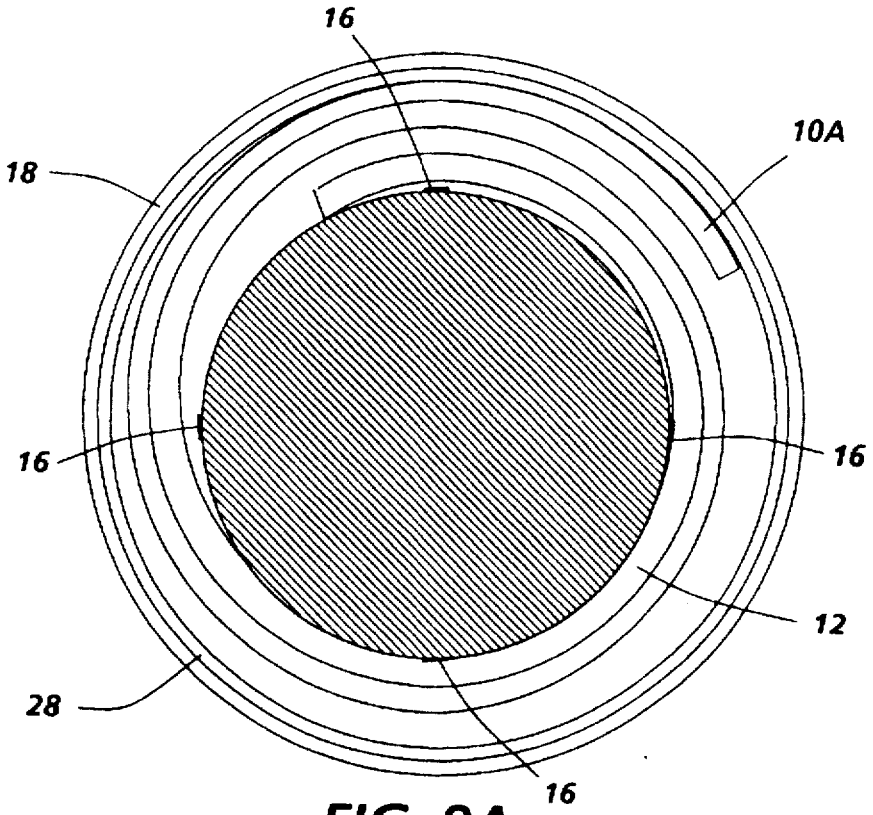
FIG. 8A depicts a plan view of the expanded clock spring and shaft assembly.
Figure 8B:
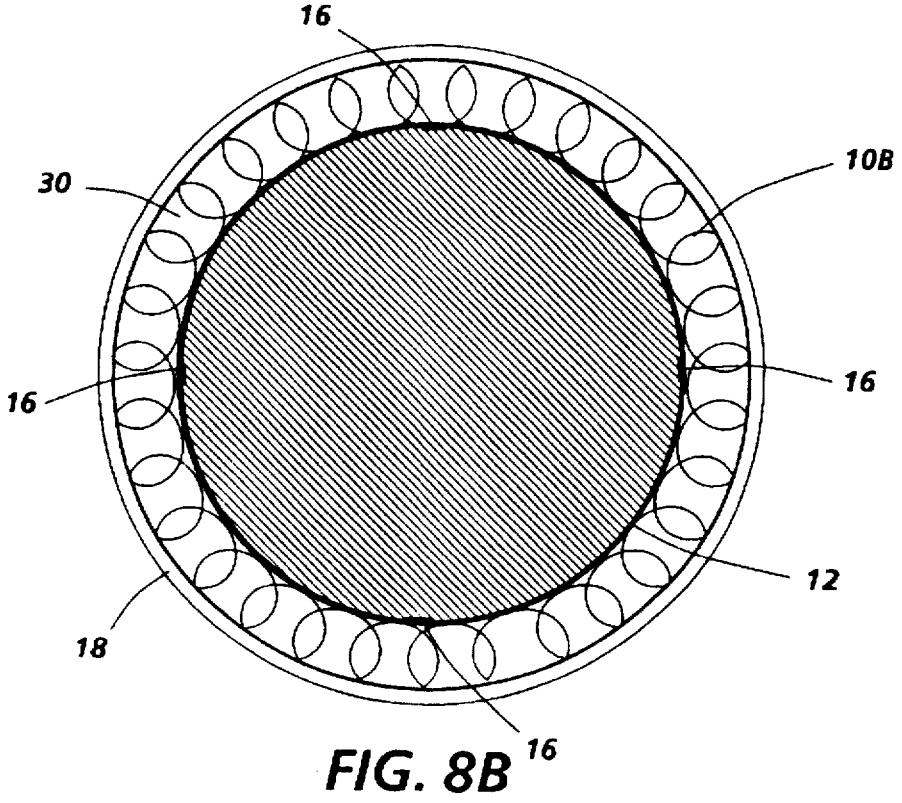
FIG. 8B depicts a plan view of the expanded coiled spring and shaft assembly.

A plan view of the expanded spring 10A is shown in FIG. 8A. Once expanded, spring 10A and shaft 12 can to be used to lift and transport flexible belt 18. Spring 10A and shaft 12 assembly will then be used to transport flexible belt 18 as it moves through a dipping and coating process. This process is used to deposit a photosensitive layer onto the outer surface of flexible belt 18, which will transform flexible belt 18 into an organic photoreceptor 26. The finished organic photoreceptor may be used in a high speed electrophotographic imaging machine. A plan view of an expanded spring 10B is depicted in FIG. 8B.

Figure 9:
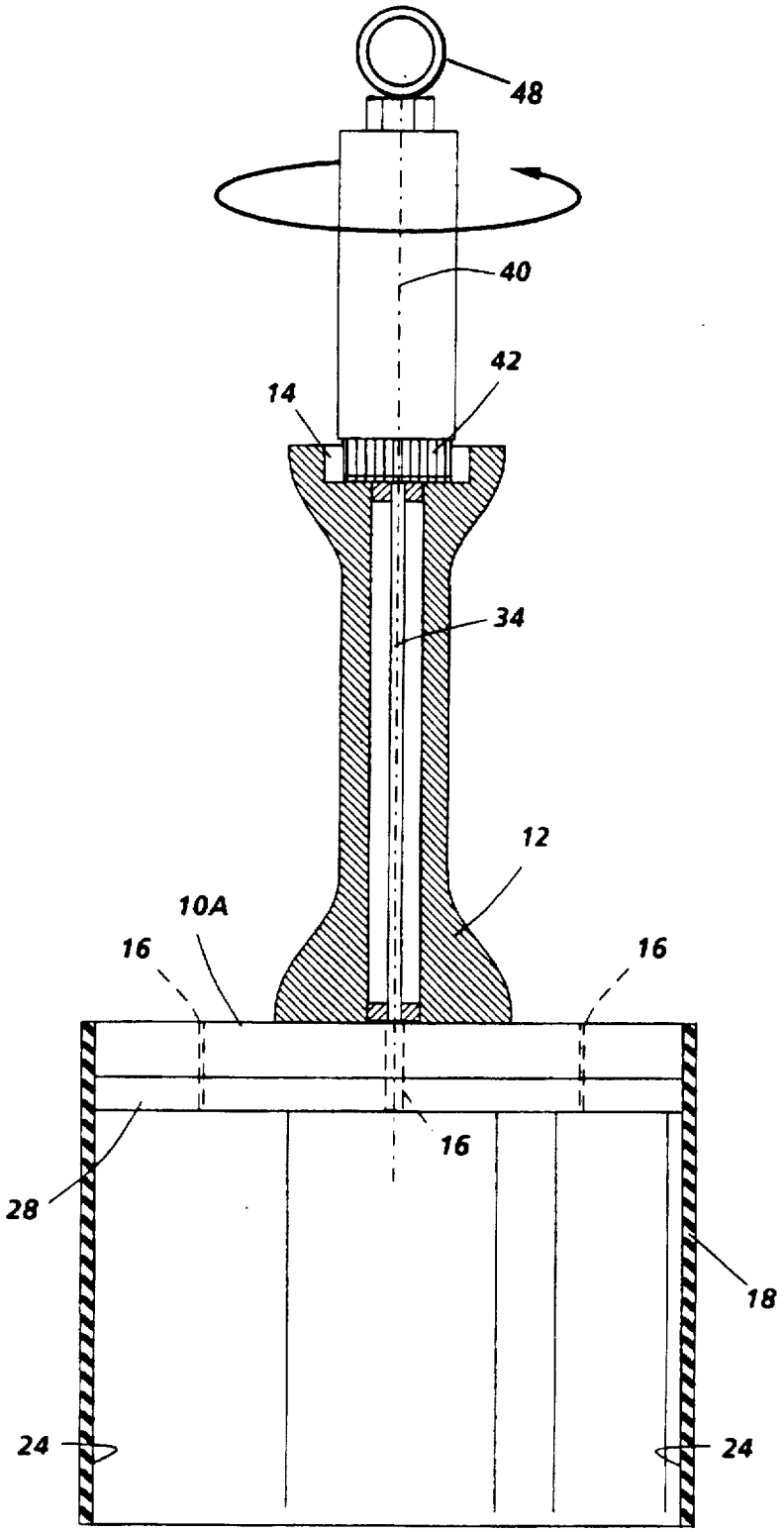
FIG. 9 depicts a gear mechanism which can be used to adjust the diameter of the spring and shaft assembly.
Figure 14:
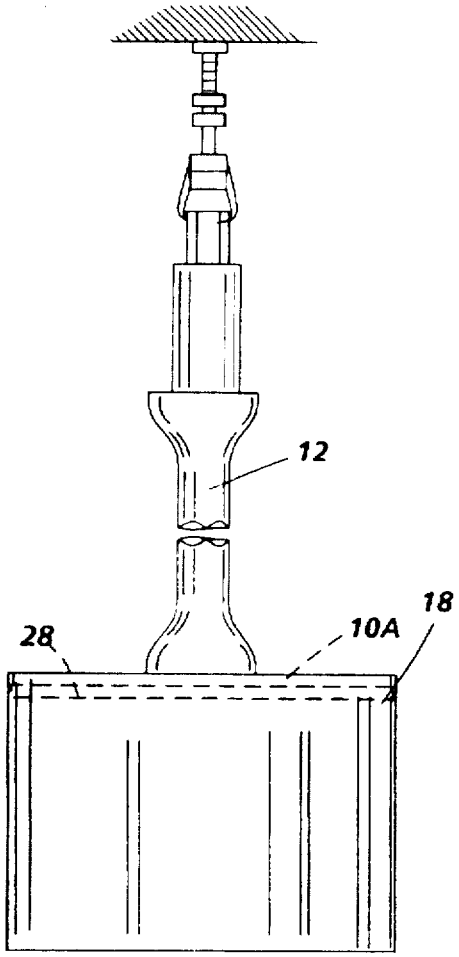

As indicated above, spring 10A and gasket 28 must expand in the radial direction to seal the inside of flexible belt 18 and transport it through dipping and coating. Expanding of spring 10A may be accomplished in many different ways. One apparatus which can be used to for this purpose is a mechanism similar to that depicted in FIG. 9. The device shown includes a shaft 40 which can be attached to a mechanical handling device at its top end. A connecting arrangement that is compatible with the shape of the mechanical handling device should be provided at the top of shaft 40 for this purpose. In one embodiment of the invention, a protrusion such as a ring 48 is attached to the top of shaft 40 in order to connect shaft 40 to a mechanical handler that would cooperate with the particular shape of the protrusion. In the alternative, the connector may be a hole and plug arrangement as indicated in FIG. 14. It should be noted that the connecting arrangement may also be used to assist in the expansion of spring 10A or 10B. Shaft 40 also has a gear 42 attached at its bottom end which meshes with gear 14. Mechanical holders 16 are located near the interior surface of spring 10A where it has been mounted to shaft 12. These holders 16 are linked to gear 14 through a rod 34 which extends downward through the center of shaft 12. The mechanism described will be used to apply and remove an outward radial force at the inside edge of spring 10A. When shaft 40 is turned, gear 42 and gear 14 will rotate, thereby causing rod 34 to turn. Rotation of rod 34 will move mechanical holders 16 in the outward direction and expand spring 10A. Shaft 40, can be turned in the opposite direction to rotate gear 42, gear 14 and rod 34 and thereby contract spring 10A. Many other methods of expanding and contracting spring 10A are possible, and means for accomplishing this task are limited only by the design of the hardware that is used in the manufacturing process.

Upon completion of dipping and coating, the outward radial force that has been applied to the inside surface 32 of spring 10A will be released, and spring 10A will move inward from the inside surface of flexible belt 18. This will allow shaft 12 and spring 10 to be lifted from the interior of organic photoreceptor 26.

An example of a manufacturing process for which this invention may be used to transform a flexible belt 12 into an organic photoreceptor 24 is depicted in FIGS. 10 through 21.

Figure 10:
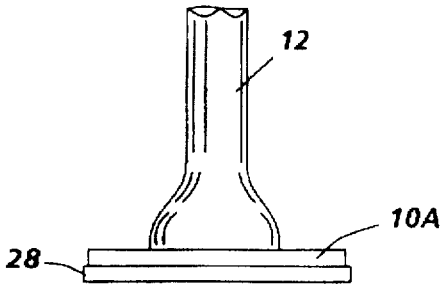
FIGS. 10 through 21 are a schematic representation of the sequence of operation of the spring and shaft as they are inserted into the flexible belt, expanded, and used to support a flexible belt as it moves through the dipping and coating process.
Figure 11:
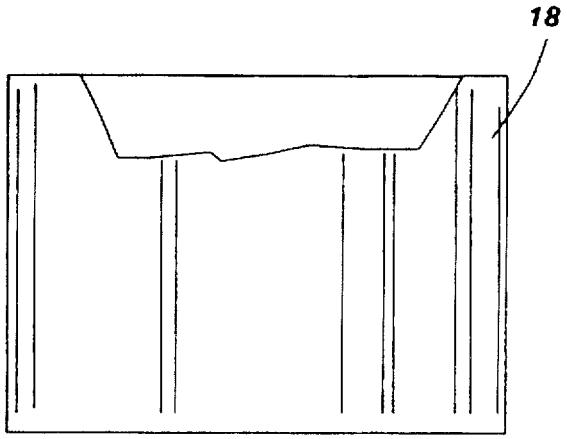
Figure 12:
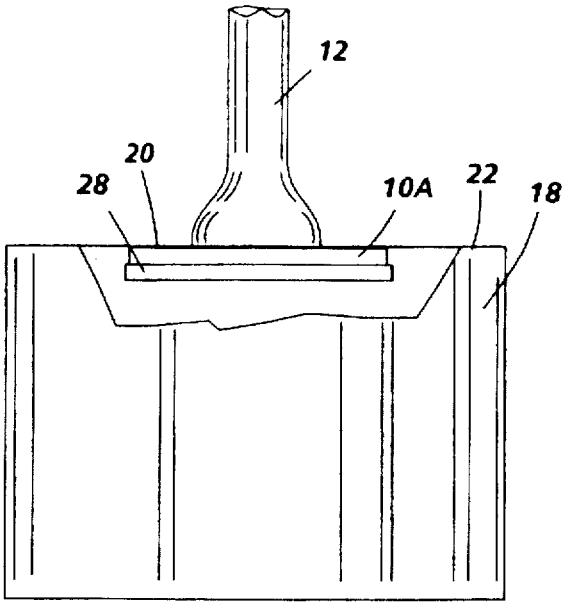
Figure 13:
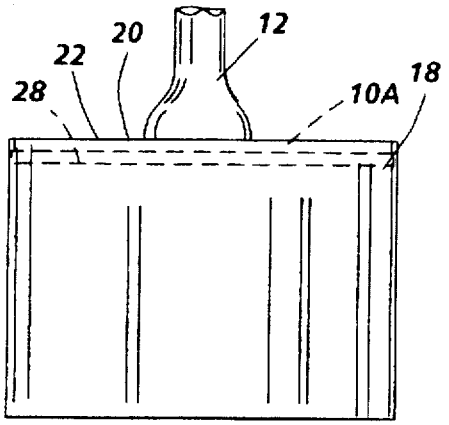
Figure 15:
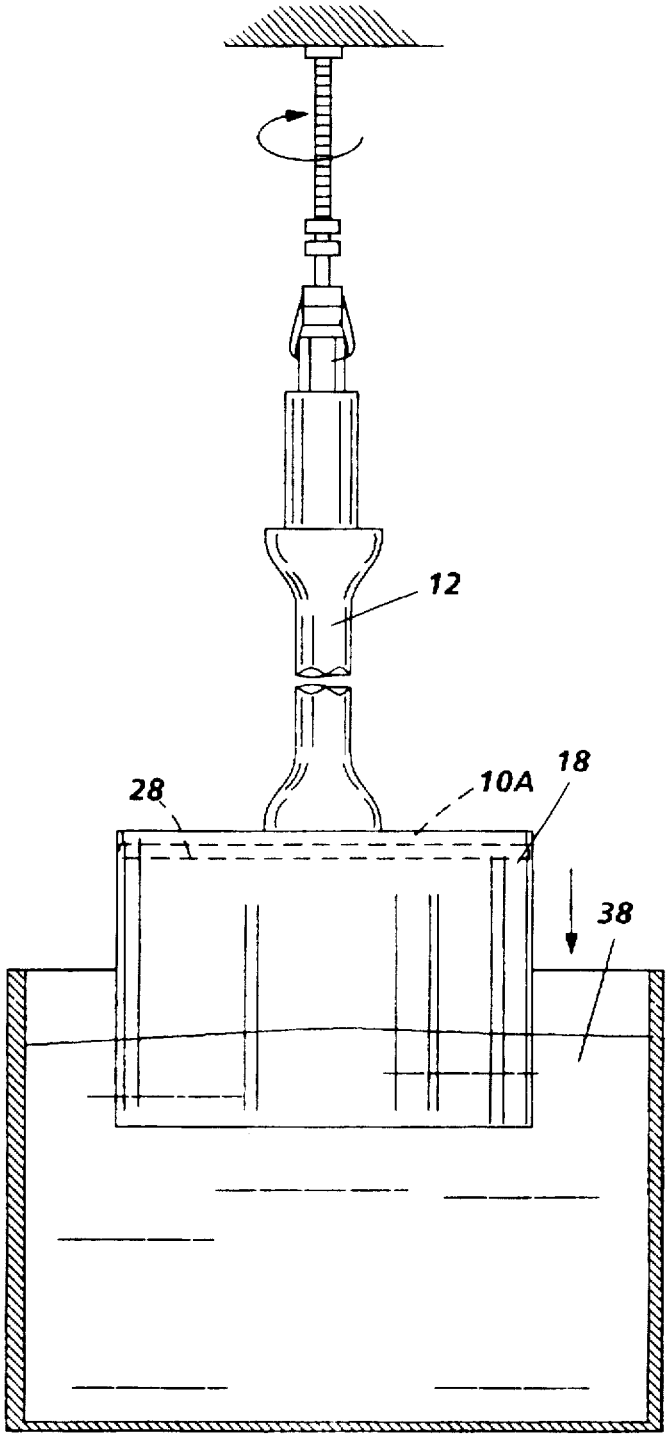
Figure 16:
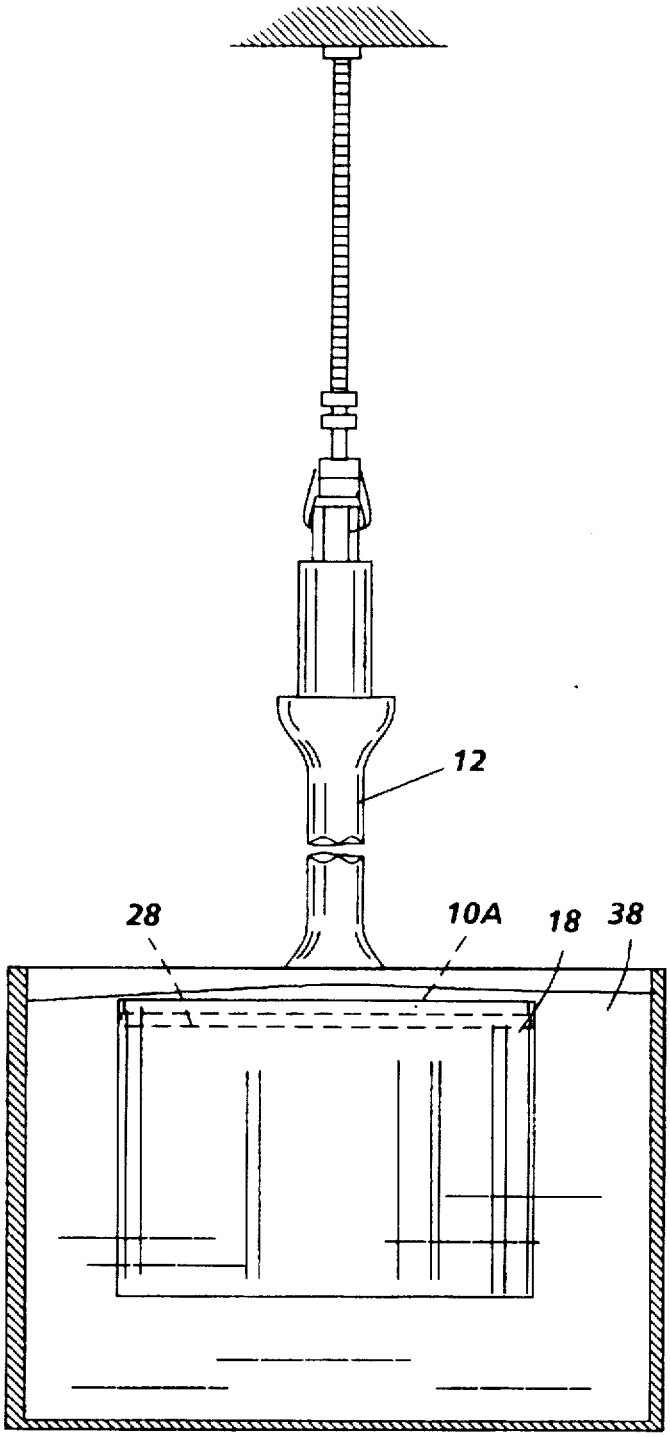
Figure 17:
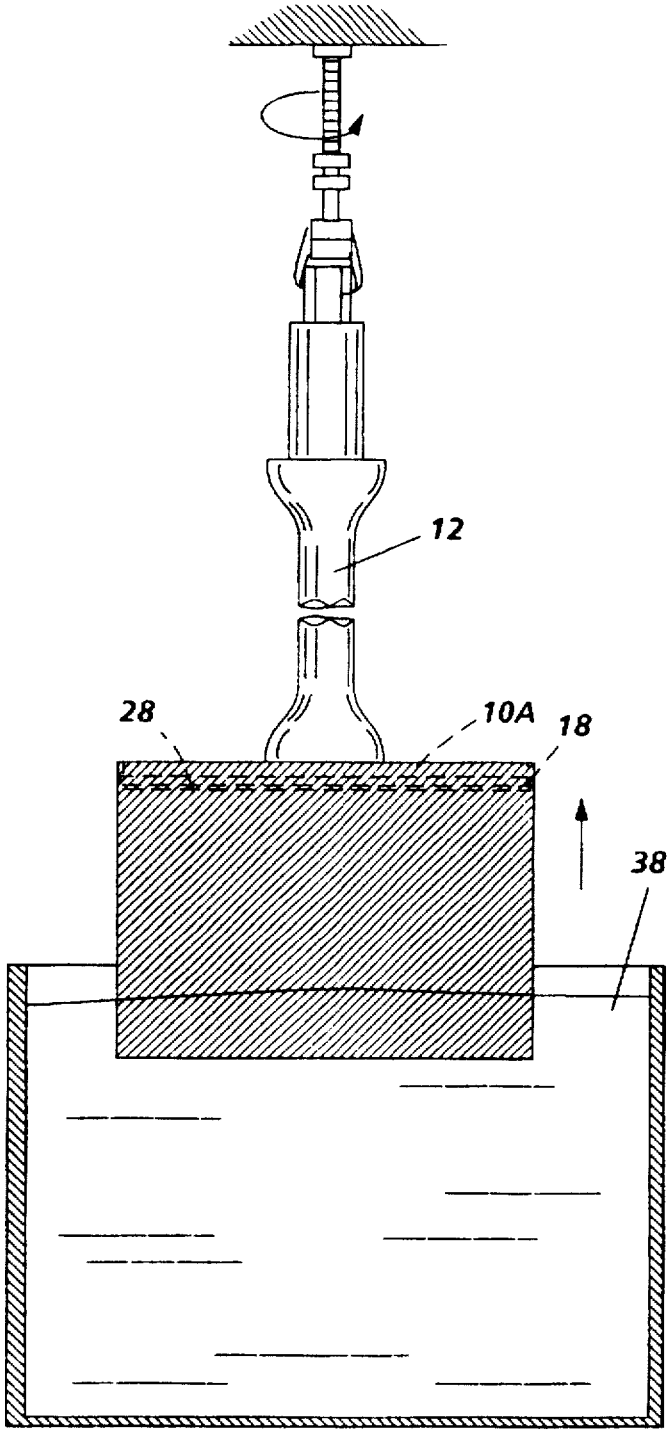

Beginning with FIGS. 10, 11 and 12, after spring 10A has been mounted to shaft 12, spring 10A and shaft 12 are inserted into the top of flexible belt 18. Shaft 40 is then rotated to cause gear 42, and gear 14 to turn, thereby causing spring 10A to expand in the radial direction. Rotation of these members continues until spring 10A is expanded such that it comes in contact with the inside surface of flexible belt 18 as depicted in FIG. 13. The top of shaft 12 is then attached to a mechanical handling device, and the handling device is used to transport spring 10A, shaft 12 and flexible belt 18 along a path as depicted in FIG. 14. Flexible belt 18 is moved along until it reaches the first of a series of dip tariks as shown in FIG. 15. These tanks contain the fluids 38 that are necessary to transform a belt into an organic photoconductive device. As illustrated in FIG. 15, the handling device is used to lower spring 10A, shaft 12 and flexible belt 18 into the dip tank, to allow flexible belt 18 to be coated with fluid 38. Once flexible belt 18 has been coated and raised from the coating tank as shown in FIGS. 16 and 17, fluid 38 is allowed to dry onto the outer surface of flexible belt 18. The belt will then be suitable for use as an organic photoreceptor 26. Many photoreceptor manufacturing processes repeat this dipping and coating sequence several times, using a different fluid 38 each time.

Figure 18:
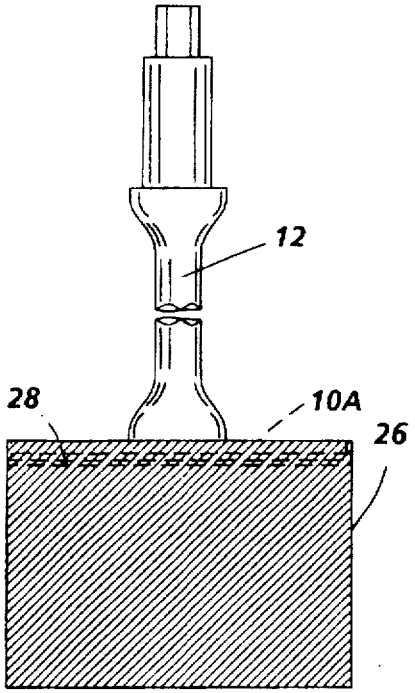
Figure 19:
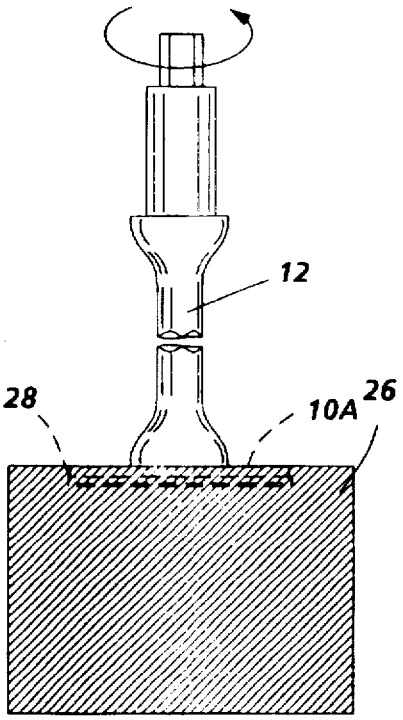
Figure 20:
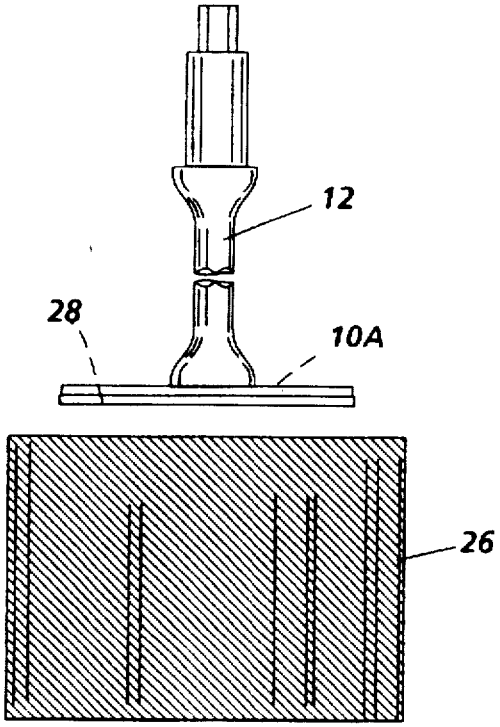
Figure 21:
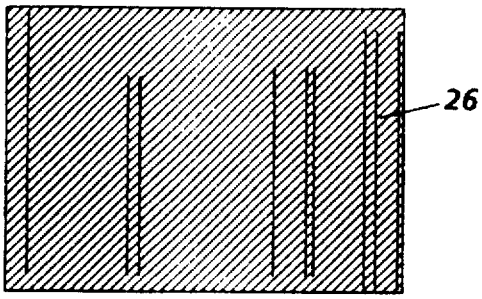

When the photoreceptor 26 is dry, spring 10A and shaft 12 must be removed from the handling device as depicted in FIG. 18. As shown in FIG. 19, this is accomplished by rotating gear 14 in the direction opposite that performed above. Shaft 12 is then raised from the inside of flexible belt 18. FIG. 20 shows shaft 12 and spring 10A after they have been removed from the inside of the photoreceptor 26. A typical finished photoreceptor 26 is depicted in FIG. 21.

Any suitable rigid or flexible substrate may be held by the apparatus of the present invention. The substrate may be at least partially hollow, and will preferably be entirely hollow, with one or both ends being open. In preferred embodiments, the substrate is involved in the fabrication of photoreceptors and may be bare or coated with layers such as photosensitive layers typically found in photoreceptors. The substrate may have any suitable dimensions.

The present invention has significant advantages over current methods for transforming flexible belts into electrophotographic imaging members. Most notably, known means for transporting these belts through the dipping and coating process often require gripping them along an edge. Gripping the belt along the edge often causes damage to its outer surface and severely compromises its performance as a photoreceptor. In the present invention the belt is supported along its inside surface rather than gripped along an edge. Holding the belt in this manner virtually eliminates the type of damage that is regularly inflicted upon the surface of the substrate by conventional means.

It is, therefore, apparent that there has been provided in accordance with the present invention, a method and apparatus for handling and dipping flexible belts using a spring chucking device that fully satisfies the aims and advantages herein set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A spring and shaft assembly for transporting and handling a flexible belt comprising:

a) a shaft having a first end and a second end;

b) a spring assembly having an inner diameter and an outer diameter, said spring assembly mounted to said first shaft end such that said inner diameter may be brought in contact with an outside surface of said shaft;

c) an activator connected to said spring assembly to vary said spring assembly outer diameter to engage and disengage an inside surface of the flexible belt;

d) a sealing arrangement which coats said spring assembly while said flexible belt inside surface is engaged thereby inhibiting a flow of surrounding fluid into an inside surface of the flexible belt; and e) a protrusion mounted to said shaft second end for attaching said shaft and said spring assembly to a mechanical handling device.

2. The spring and shaft assembly of claim 1 wherein said spring assembly comprises:

a) a clock spring; and b) a gasket attached to a planar surface of said clock spring.

3. The spring and shaft assembly of claim 2 wherein said varying of said spring assembly diameter comprises rotating a ring located at said second shaft end and connected to said spring assembly by way of a gear mechanism, thereby causing said spring assembly diameter to expand and contract in a radial direction.

4. The spring and shaft assembly of claim 2 wherein said sealing arrangement for preventing contact of an inside surface of the flexible belt comprises a forming a fluid impermeable seal between said gasket and said flexible belt inside surface as said spring assembly diameter is varied.

5. The spring and shaft assembly of claim 2 wherein said gasket is made from a dimensionally stable, chemically inert, heat resistant elastomer.

6. The spring and shaft assembly of claim 1 wherein said spring assembly comprises:

a) a retractable coiled spring; and b) an expandable coating encasing said spring.

7. The spring and shaft assembly of claim 6 wherein said varying of said spring assembly diameter comprises rotating a ring located at said second shaft end and connected to said spring assembly by way of a gear mechanism, thereby causing said diameter of said spring assembly to expand and contract in a radial direction.

8. The spring and shaft assembly of claim 7 wherein said sealing arrangement comprises bringing said coated spring in firm contact with an inside surface of the flexible belt as said diameter of said spring assembly is expanded.

9. The spring and shaft assembly of claim 6 wherein said coating is made from a dimensionally stable, chemically inert, heat resistant elastomer.

* * * * *